United States Patent [19]

Rusbach

[11] 4,214,372

[45] Jul. 29, 1980

[54] AIMING INSTRUMENT

[75] Inventor: Maurice Rusbach, Nyon, Switzerland

[73] Assignee: Sarmac S.A., Carouge, Switzerland

[21] Appl. No.: 819,987

[22] Filed: Jul. 28, 1977

[30] Foreign Application Priority Data

Aug. 12, 1976 [CH] Switzerland ..... 10249/76

[51] Int. Cl.[2] ..... F41G 1/02

[52] U.S. Cl. ..... 33/252; 33/283; 33/334; 33/365; 33/377; 42/15

[58] Field of Search ..... 33/334, 365, 283, 371, 33/377, 370, 265, 252, 254, 235, 282, 244, 377, 384, 385, 374; 42/15, 1 F; 89/41 F

[56] References Cited

U.S. PATENT DOCUMENTS

| | | | |
|---|---|---|---|
| 1,603,386 | 10/1926 | Haubroe | 33/370 |
| 2,048,687 | 7/1936 | Coupland | 33/371 |
| 2,330,603 | 9/1943 | McNally | 33/283 |
| 2,478,898 | 8/1949 | Darr et al. | 33/235 |
| 2,482,749 | 9/1949 | Eckert | 33/282 |
| 2,487,828 | 11/1949 | Playdon | 33/235 |
| 2,488,836 | 11/1949 | Sweetman | 33/241 |
| 2,541,215 | 2/1951 | Davis | 33/377 |
| 3,013,336 | 12/1961 | Pennington | 33/334 X |
| 3,568,325 | 3/1971 | Baltz | 33/377 |

*Primary Examiner*—William D Martin, Jr.
*Attorney, Agent, or Firm*—Young & Thompson

[57] ABSTRACT

The invention relates to an aiming instrument for a small arms weapon comprising an arrangement for directional aiming and an arrangement for vertical aiming, wherein the directional and vertical arrangements are integral and a fixing device is provided to connect them detachably to the barrel of the weapon; the directional aiming arrangement includes an alidade; and the vertical aiming arrangement comprises at least one partially transparent chamber containing at least one movable mass which is displaced opposite a scale.

2 Claims, 34 Drawing Figures

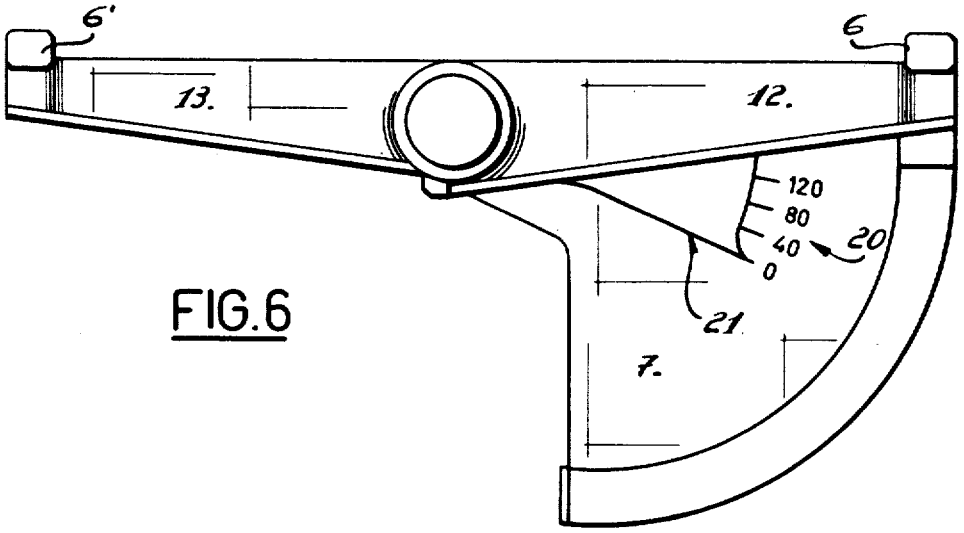
FIG.6
FIG.7
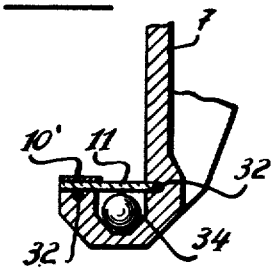
FIG.8
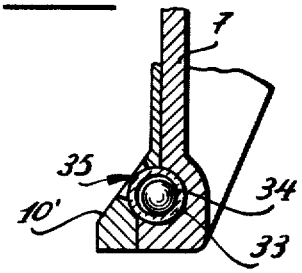
FIG.13
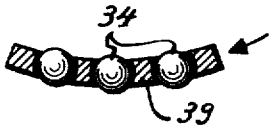
FIG.9
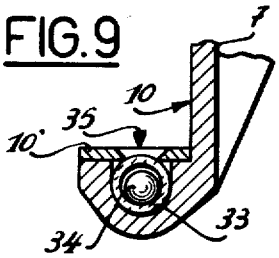
FIG.14
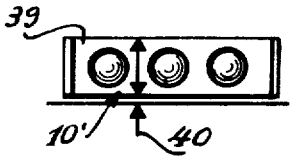
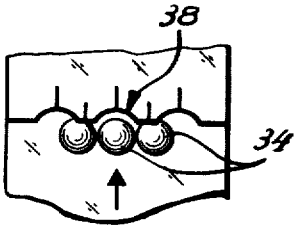
FIG.12
FIG.10
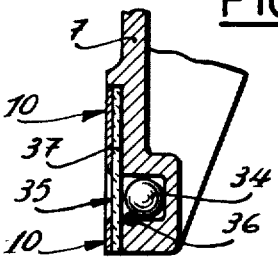
FIG.11
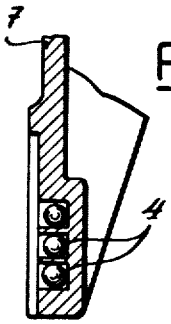

FIG. 20
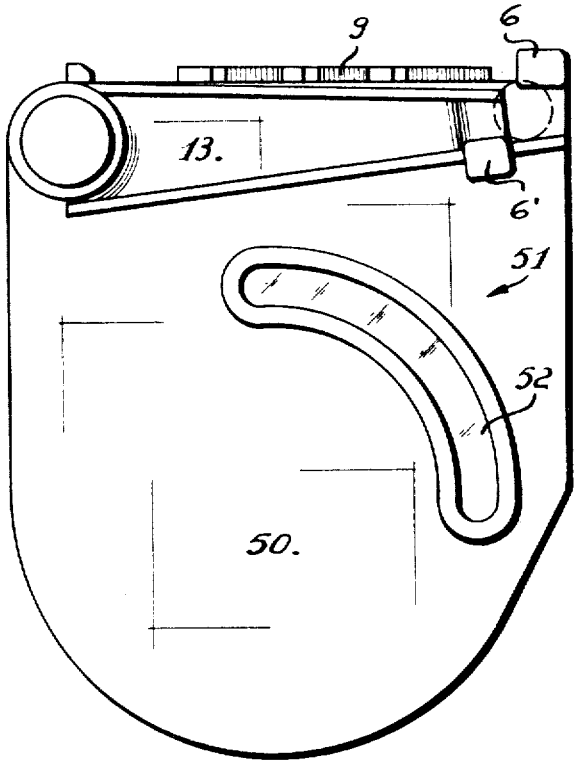
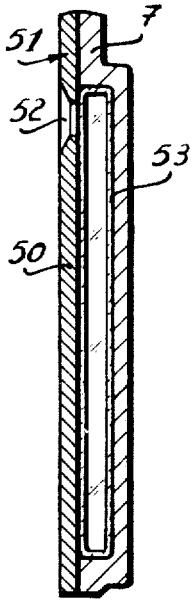
FIG. 22
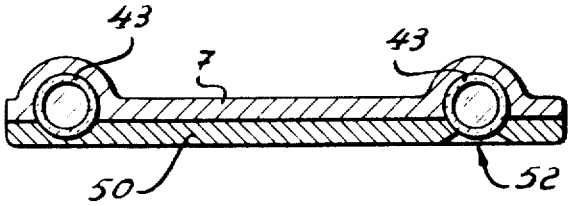
FIG. 21

FIG. 25
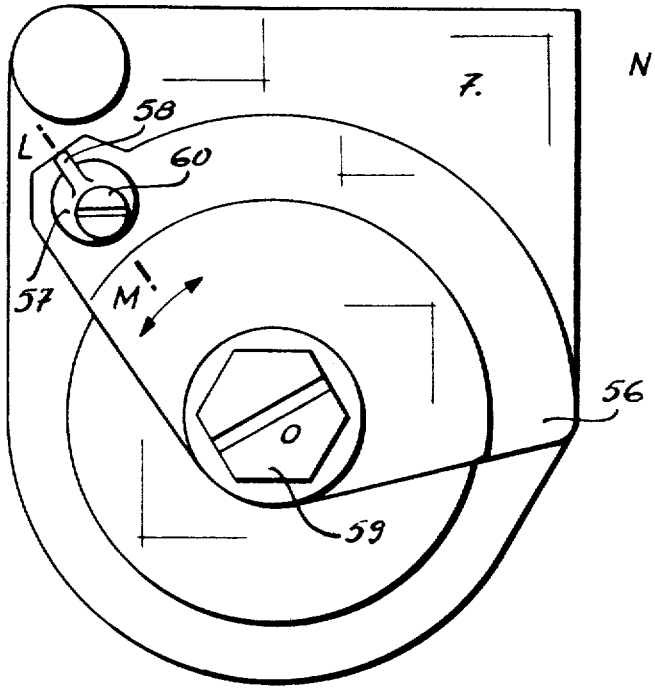
FIG. 26
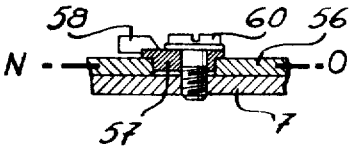
FIG. 27
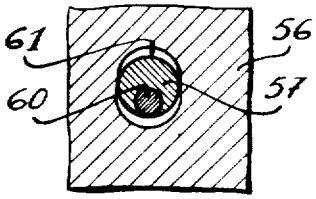
FIG. 29
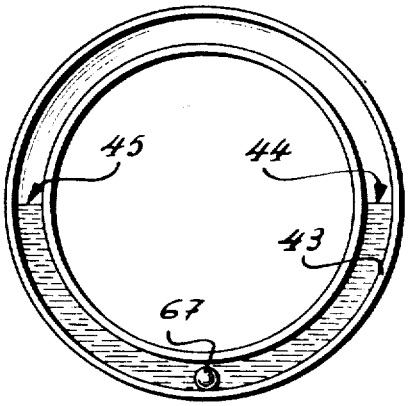
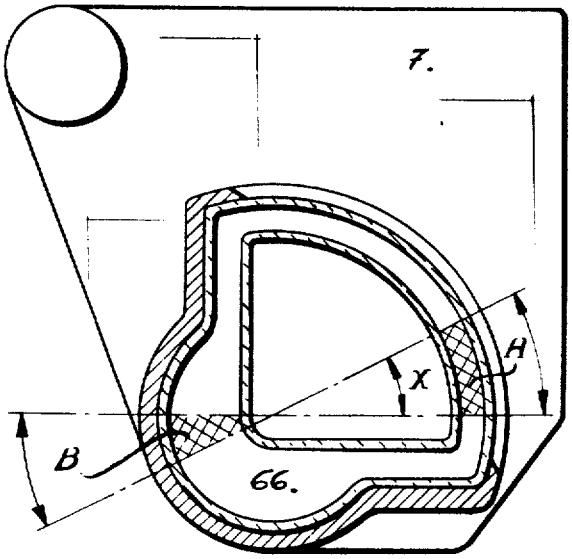
FIG. 28

AIMING INSTRUMENT

This invention relates to an aiming instrument to be fitted on all types of infantry weapons, particularly light weapons which are suitable for curved or flat-trajectory firing and more particularly but not exclusively for launching explosive missiles, such as guns for firing grenades, grenade launchers, mortars of various types, and rocket launchers.

An aiming instrument according to the invention, comprising an arrangement for directional aiming and an arrangement for vertical aiming, is characterized in that the arrangements for directional and vertical aiming are integral and that a fixing device enables them to be joined detachably to the barrel of a weapon; that the directional aiming arrangement comprises an alidade; and that the vertical aiming arrangment comprises at least one partially transparent chamber, containing at least one movable mass which is displaced opposite a scale.

Figure 1:
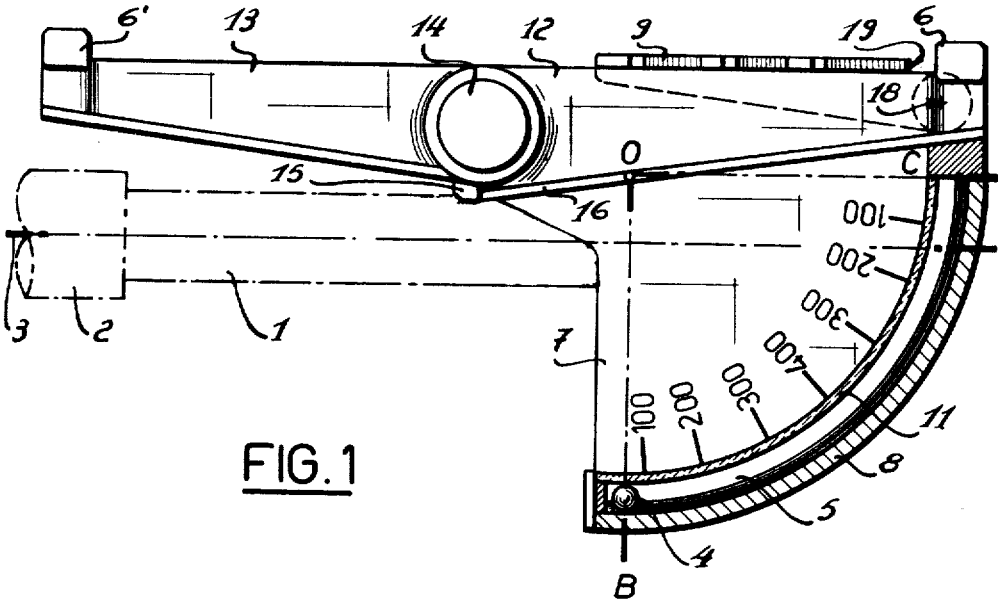
Figure 3:
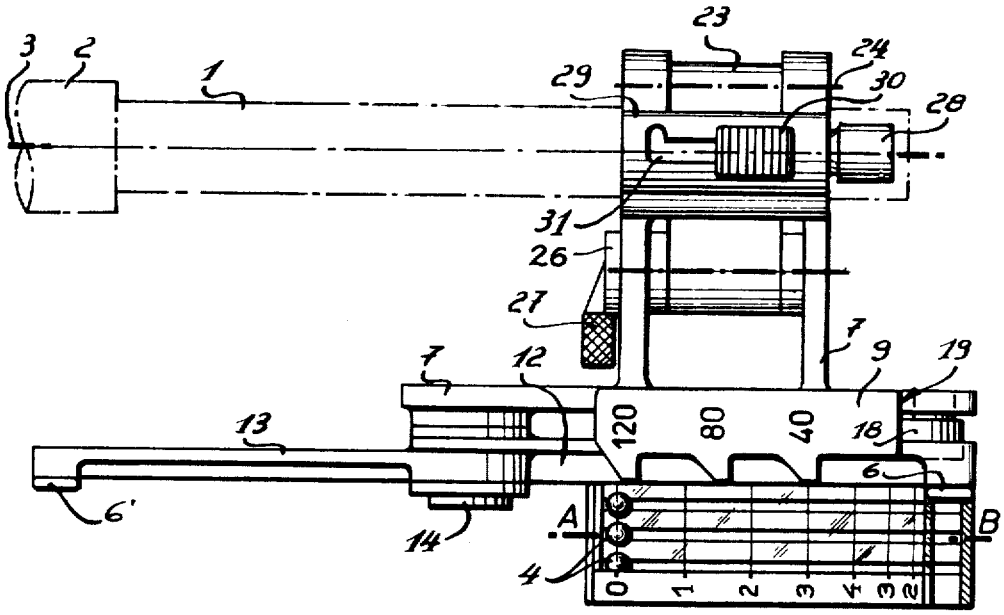
Figure 2:
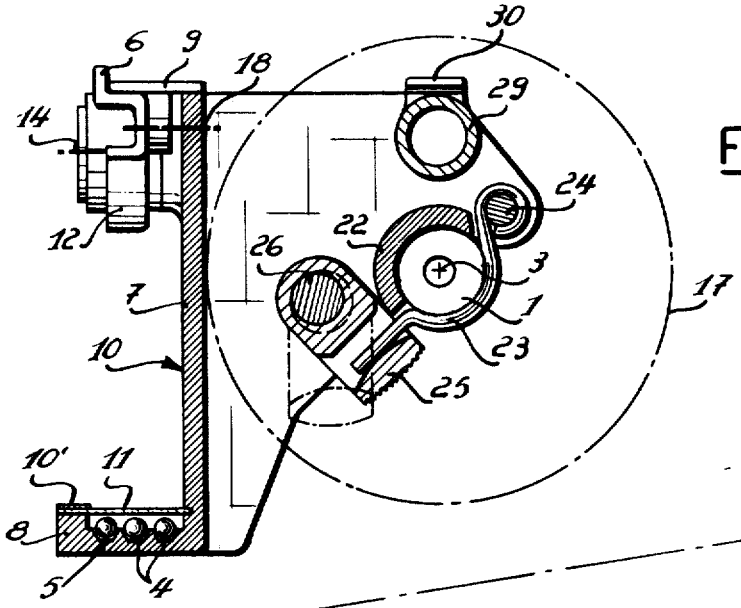
Figure 4:
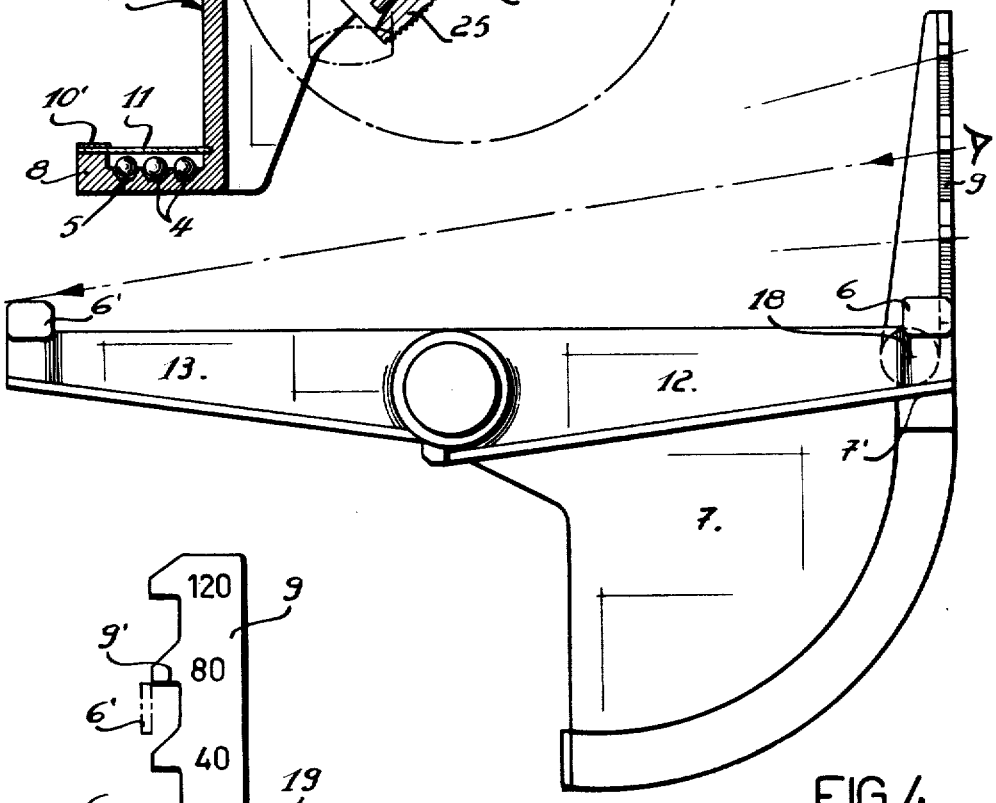
Figure 5:
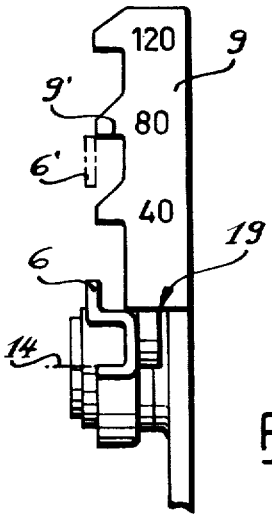
Figure 15:
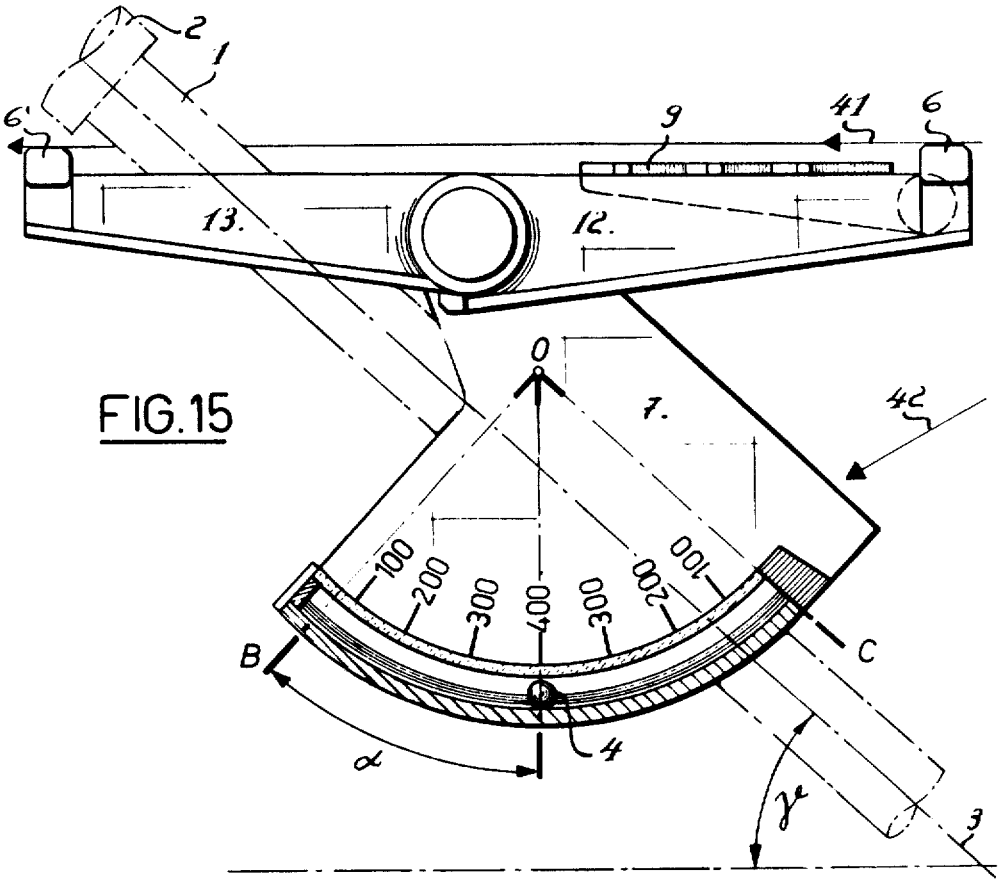
Figure 24:
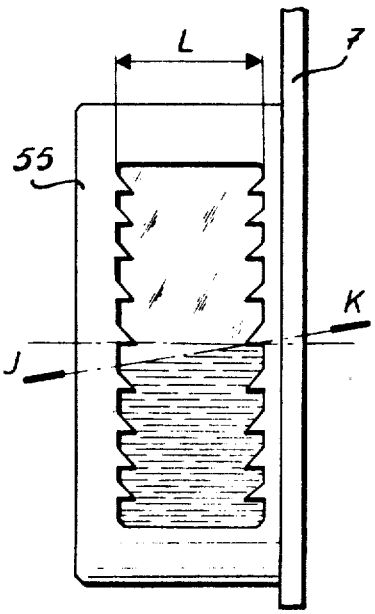
Figure 23:
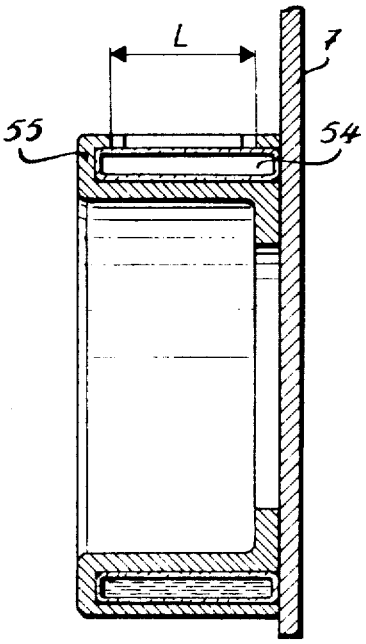
Figure 32:
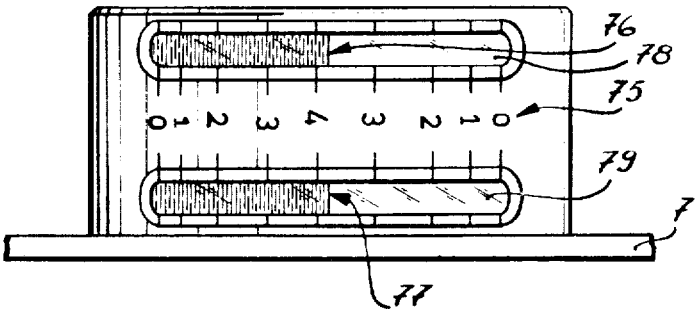
Figure 33:
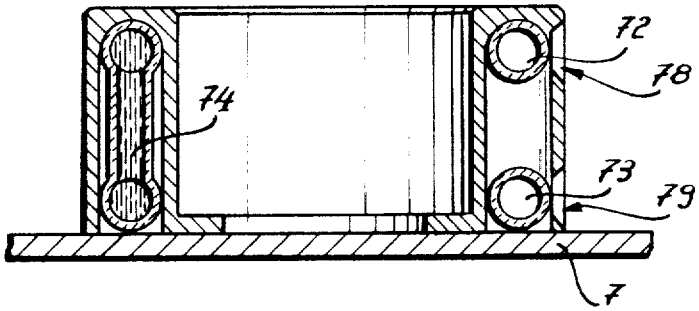
Figure 33:
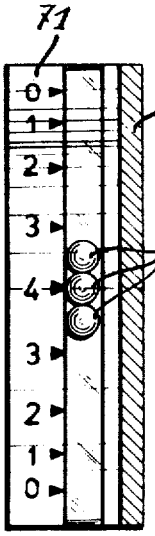
Figure 31:
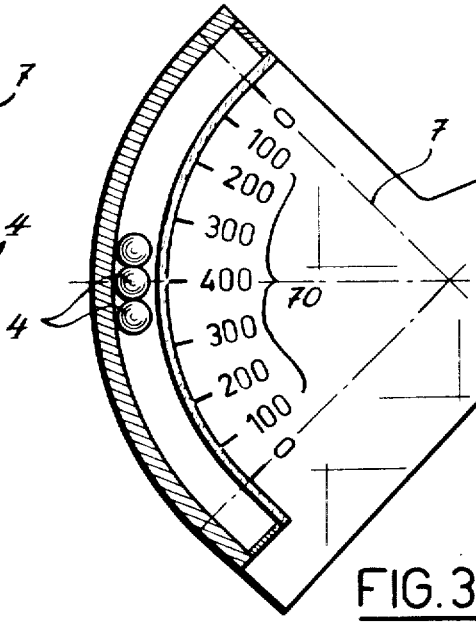
Figure 30:
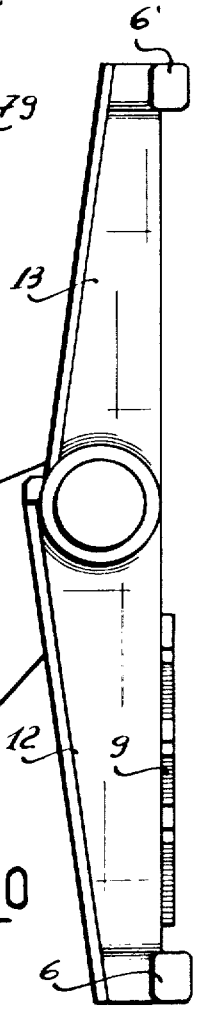
Figure 34:
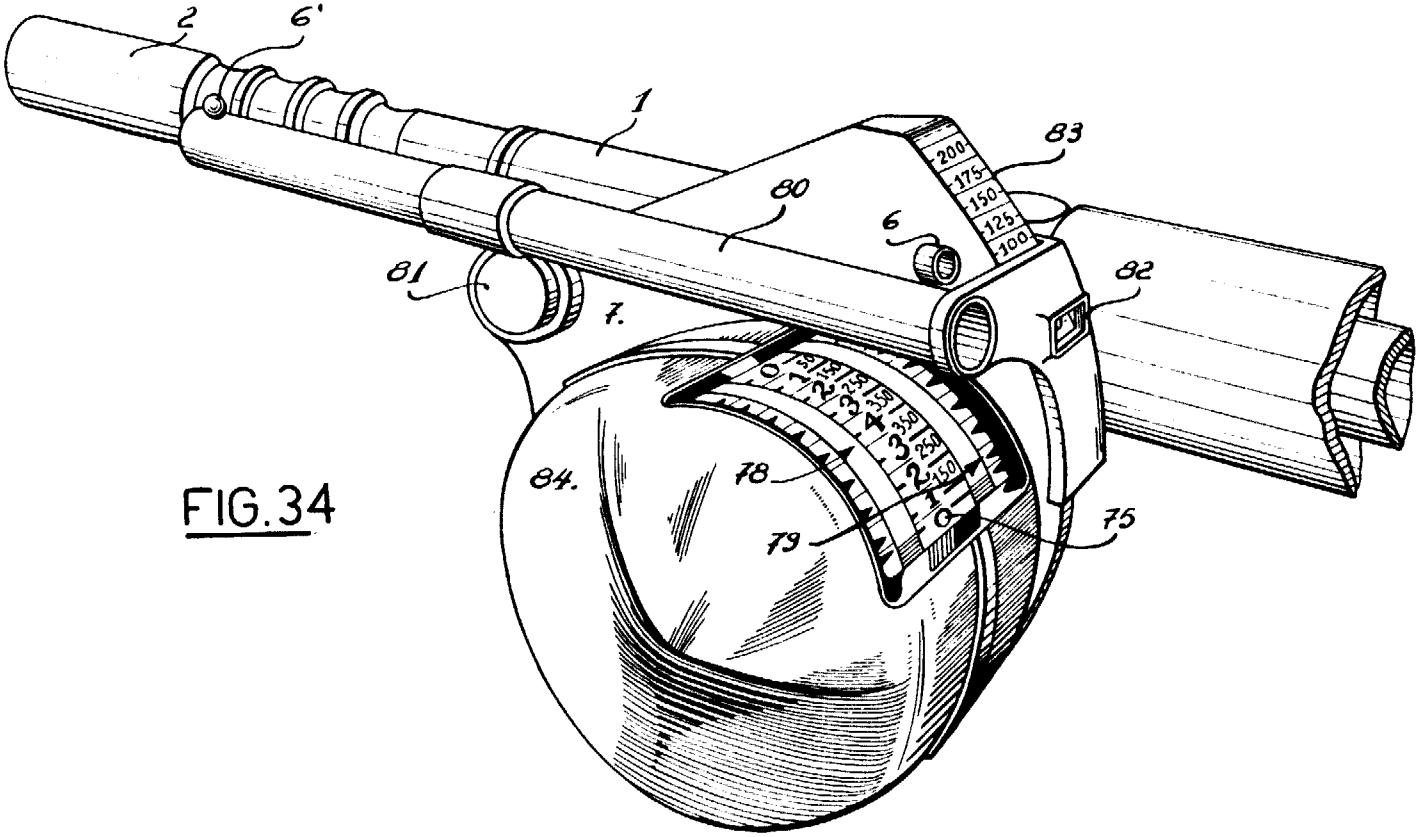

Various embodiments of the aiming instrument according to the invention are illustrated diagrammatically, by way of exemple, in the accompanying drawings, in which:

FIGS. 1 to 3 illustrate a ball-type aiming arrangement,

FIGS. 4 and 5 show the alidade of the arrangement illustrated in FIGS. 1 to 3, with a grid (grille) for aiming in the opened-out position, FIG. 6 shows a different form of the alidade, FIGS. 7 to 14 show various forms of the chamber containing the ball or balls, FIG. 15 shows the arrangement from FIGS. 1 to 3 positioned for use on the barrel of a weapon, FIGS. 16 to 19 illustrate an embodiment of the vertical aiming arrangement, wherein the movable mass is in the form of a liquid, FIGS. 20 to 22 illustrate a different embodiment of the liquid-type vertical aiming arrangement, FIGS. 23 and 24 show different forms of the chamber containing the liquid, FIGS. 25 to 27 show a vertical aiming arrangement with a possibility for adjusting the scale, FIGS. 28 and 29 show a different embodiment of the liquid-type vertical aiming arrangement, FIGS. 30 and 31 show a final embodiment of the liquid-type vertical aiming arrangement, FIGS. 32 and 33 show a different embodiment of the chamber containing the liquid and, FIG. 34 is a perspective view of a preferred embodiment of the directional and vertical aiming arrangement.

The directional and vertical aiming instrument is chiefly designed to be fixed on the barrel of an infantry weapon which is used for curved or flat-trajectory firing and which may or may not be equipped with a support. Examples of such weapons are rifles with jackets for firing grenades, mortars and rocket lauchers for example.

In this type of firing the marksman himself provides the weapon support with its adjustment mechanisms. Failing any fixed hold for the weapon between two firing operations, therefore, the firer must have an intangible reference which will give him an unquestionable base for adjustment. This is not provided by most of the aiming instruments at present in use, which are often rudimentary in design and give too much scope to the judgement of the marksman. The purpose of the present arrangement is inter alia to counteract the absence of any reference by using the force of gravity, by means of a simplified pendular system with a ball or a liquid (geocentric reference).

The constancy of the source of gravity provides an intangible base for the repetition of identical shots or the correction of shots relative to that base. It is also possible to adjust the shot immediately and accurately over a given distance.

From this perfectly established geocentric base it is possible to return very accurately to the angle of the previous aim, and this can be done as many times as necessary.

After inaccurate firing and observation of the points hit, the other factors such as evaluation of the distance, atmospheric agents (wind) etc., may be corrected from this reference.

In addition to the improved accuracy the speed of use is increased, through the opportunity given to the marksman to return immediately to the reference position, which is found without hesitation and without making tentative efforts.

As will be seen from the description which follows, the main advantages in use are:

The absence of any adjustment other than the inclination of an alidade in the vertical plane in the direction of the target.

Direction of aim and range of aim simultaneous in the same ocular field.

Target unmasked.

Vertical aiming is thus extremely simple: the marksman merely has to change the position of the weapon so that the aiming elements are finally brought in front of their respective references, that is to say, the alidade in the direction of the target, the ball or balls or the liquid level on the range scale.

FIGS. 1, 2 and 3 show a vertical aiming (pointage) arrangement with a ball 4, of the pendular type, fixed to the barrel of a rifle 1 which is extended by its grenade launching jacket 2. The reading angle involving the two trajectories, namely for direct aiming and for range aiming, is 90°. The system for fixing the instrument on the barrel is designed to make the axis 3 of the barrel perpendicular to the line OB and parallel to the line OC. Under these conditions, when the axis 3 of the barrel is in a perfectly horizontal position, the center of the ball 4 will lie on OB (FIG. 1). In the vertical position its center will lie on OC. Thus angular displacement of the barrel above the horizontal will lead to identical angular displacement of the ball 4 along its race 5, caused by the force of gravity, the directional axis of which passes through the centre of the earth (hence geocentric aiming).

Conversely, one therefore only has to make the ball register with a graduation corresponding to a given angular value to determine an exactly identical inclination of the barrel, in order to obtain the desired range. The angular values on the scale are replaced by linear values to permit direct reading.

For trajectory fire an aiming unit must comprise at least two means which cannot exclude one another, defining the range by the angle of elevation and the direction of the trajectory by direct aiming on to the real or auxiliary target (with a means for judging the verticality of the plane of the trajectory). In the case described the means for directional aiming is represented by an alidade 6,6'. The direction and range are read simultaneously.

The instrument comprises a flange or frame 7 with all its elements fixed to it.

As shown in FIGS. 1, 2 and 3, on its front surface at the reading side an arcuate cradle 8 of the race or races 5 for the ball or balls 4 is cast or assembled integrally with the flange 7. The balls 4 are kept on their tracks 5 with a certain play by a protector 11 made of transparent material, which protects them and seals them to prevent foreign bodies, e.g. dust, mud, from entering. As shown in FIG. 2 three balls are used, so as to form a line to facilitate reading.

Graduations 10 on the vertical surface of the flange are in meters and graduations 10' on the horizontal face in hectometers.

The alidade 6,6' is made up of two limbs 12 and 13 which can be folded back for transportation. This permits a considerable lengthening of the alidade between the two sighting marks 6 and 6', an important factor in its accuracy. The limb 13 is connected to the hub of the master limb 12, which itself pivots on a stationary spindle 14 on the frame 7.

The opening out of the alidade is limited by stops 15 and 16 mounted on the limbs 13 and 12. When the stops are in contact the sighting marks 6 and 6' are aligned. The inclination of this line of sight is adjusted by raising and lowering the limb 12. With this arrangement the target is completely unmasked on the line of sight; the line of sight is outside the profile of the missile, which here has a large diameter by way of example.

For flat-trajectory firing the limb 12 has an aiming grid 9 which can be folded back and which is connected to the limb at 18. FIGS. 4 and 5 show the grid 9 raised to the position of use at 90° to the line of sight. Its movement is limited by a stop 19, coming into contact with the limb 12. Here again the limb is designed so that the target is completely unmasked. Aiming takes place as illustrated in FIG. 5, by making the sighting mark 6' register with an edge 9' marked with a graduation at the desired range.

For this method of aiming, the line of sight 6—6' is perfectly parallel with the axis 3 of the barrel 1. This geometric position is obtained by having the end of the limb 12 in contact with a stop 7'.

In a different embodiment for aiming during flat-trajectory firing, the grid 9 may be replaced by the arrangement illustrated in FIG. 6. In this case the grid is omitted and the inclination of the line of sight is defined by a graduation 20 engraved on the flange 7 and a reference mark 21 on the limb 12. The elevation is established by bringing the reference mark 21 in front of the graduation for the desired range.

The importance of the first embodiment with a grid is that the marksman can alter the range while aiming, without making any other changes.

The aiming instrument includes a means for fixing it on the barrel.

The fixing device illustrated is self-centering, that is to say, it automatically locates the aiming instrument relative to the axis of the barrel. Its locking action is rapid and firm. It comprises a half-jaw 22 on the frame 7, the curvature of the jaw corresponding to the diameter of the barrel, a movable jaw 23 of sheet steel connected to a spindle 24, and a pivoted locking stirrup piece 25 which leaves the jaw 23 completely free in the open position.

In the locked position illustrated, locking the jaw 23 to the barrel is completed by rotating a cam shaft 26 controlled by a lever 27. This causes the stirrup piece 25 to engage the end of the jaw 23.

The function of a vent obturator 28 is to prevent gases from reaching the operating member of the weapon while grenades are being fired. It also serves to locate the aiming instrument angularly relative to the barrel in its position of use.

The obturator can be retracted inside a sleeve 29 to enable the weapon to be operated automatically again without having to remove the aiming instrument. The retracting movement is produced by a pusher 30 movable within a slot 31 (FIG. 3).

FIGS. 7 to 14 show different ball race designs.

FIG. 7 is a cross section through a single race for one ball 34 (three balls one behind the other are shown in FIG. 12). The race is protected by a protector made of transparent material 11 which seals it in conjunction with plastic keeper rings 32.

In FIG. 8 the race is formed by a tube of transparent material 33, the ball or balls 34 being visible through an aperture 35.

In FIG. 9 the reading area is perpendicular to the flange 7.

FIG. 10 shows a race machined into the thickness of the flange 7. A keeper ring 36 prevents the ball 34 from coming into contact with the transparent protector 37.

In FIG. 11, in contrast FIGS. 1, 2 and 3, the races are machined concentrically into the thickness of the flange 7 so that the balls 4 form a vertical reading line instead of a horizontal one.

FIG. 12 shows an arrangement with three free balls 34 on a race.

It also illustrates a method of indexing the scale, with a notch 38 mating with the profile of the central ball.

FIGS. 13 and 14 are side and plan views respectively of balls 34 which are housed in a runner 39 like a portion of a ball bearing cage; the reading index 40 is engraved on the upper surface of the runner.

FIG. 15 shows the aiming instrument positioned for use at an angle close to the maximum range. The barrel 1 and jacket 2 of the weapon are drawn in dash and dot lines. The ball race sector is cut along the line AB in FIG. 3, and the alidade 6—6' is aligned with the target. Arrows 41 and 42 show the direction of sight for aiming and the direction of sight for reading respectively.

Figure 17:
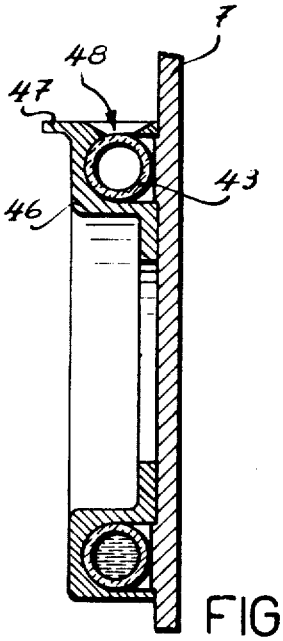
Figure 16:
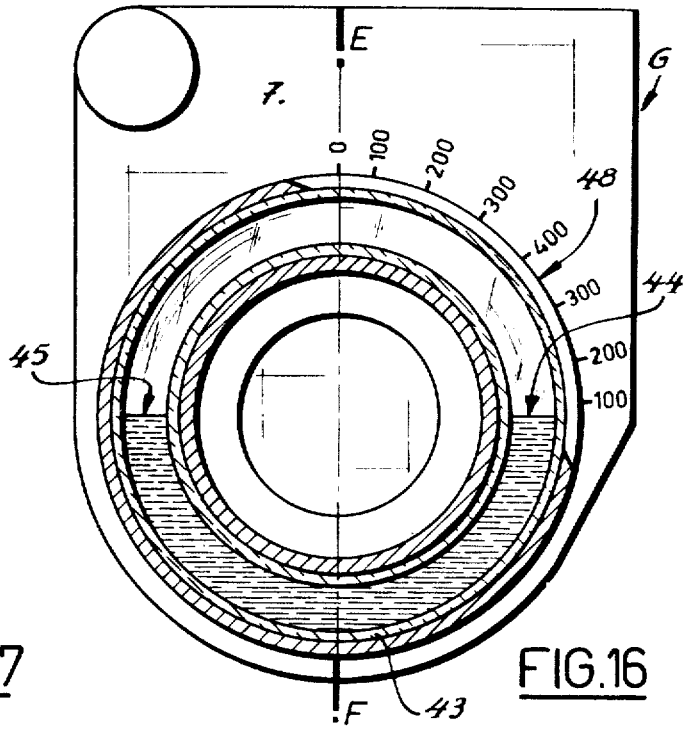

In the embodiment illustrated in FIGS. 16 and 17 the pendular effect is exploited by means of a liquid instead of balls as in the previous arrangements. The opaque coloured liquid is contained in an annular tube 43 of transparent material, the contents of which represent half its capacity.

A straight line passing through the two ends 44, 45 of the liquid arc represents the horizontal. However accurately the tube is filled relative to half its capacity, the point 0 on the scale must coincide with that line or level 44, 45 when the axis of the barrel of the gun is in a perfectly horizontal position.

The annular tube 43 is contained in and protected by a casing 46 which has a scale 47 in hectometers (the meters being on the flange 7) and a reading aperture 48.

Figures 18, 19:
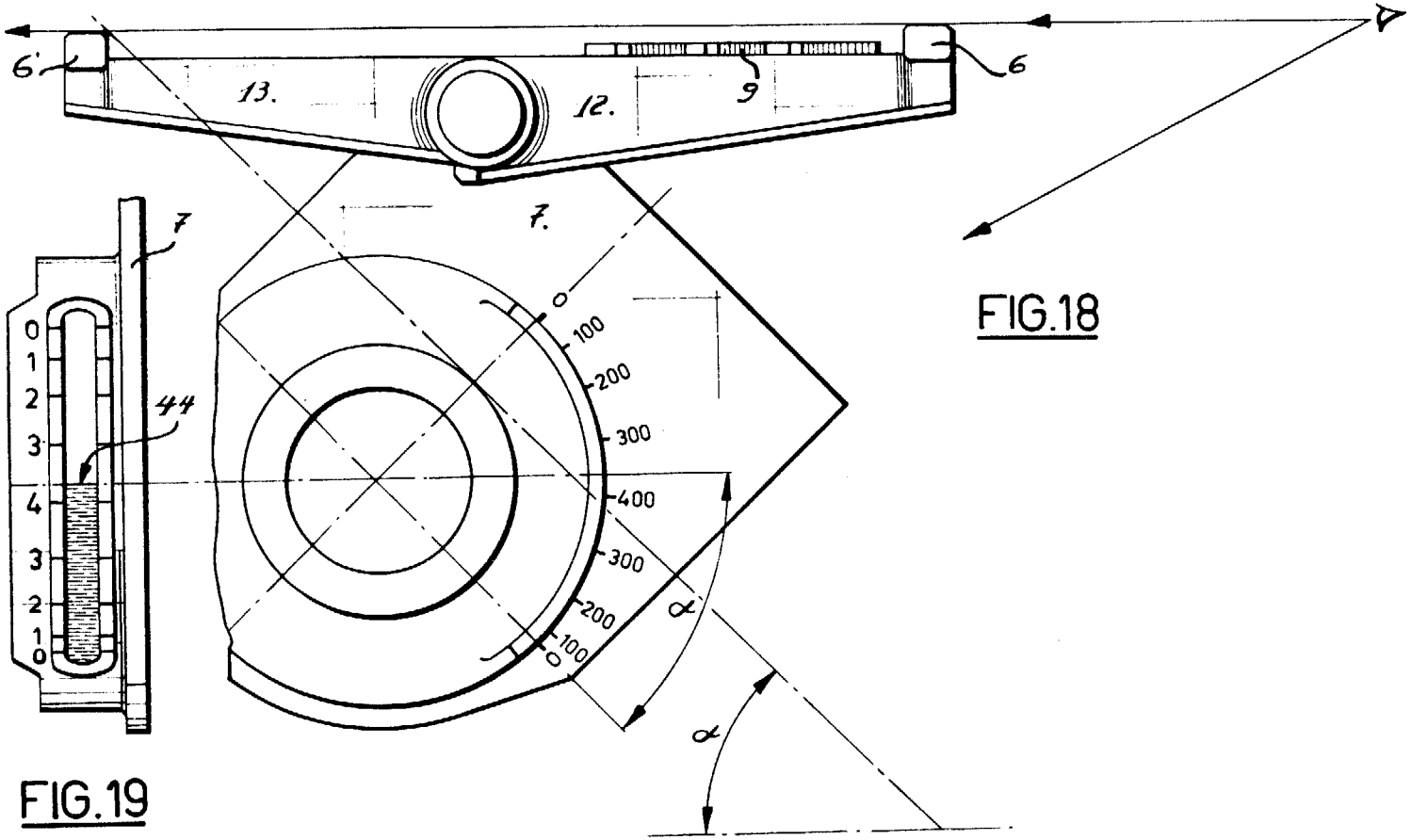

FIG. 16 shows the tube 43 and its casing 46 in cross section. FIG. 18 shows the instrument illustrated in FIG. 16 in its aiming position. It will be noted that the field of vision is the same for directional aiming and for reading the range. The range scale is opposite the marksman's eye, thus enabling him to read the two sets of data simultaneously.

In the embodiment illustrated in FIGS. 20 and 21 the alidade is shown in the retracted position and the tubular ring, housed in the flange 7 of the frame of the instrument, is protected and held by the plate 50, which carries a range scale 51 in meters and a reading aperture 52.

In FIG. 22 the tubular ring 43 is replaced by a flat circular container 53 housed in the flange 7. It is protected by the same plate 50.

FIGS. 23 and 24 illustrate a design which provides an extra accuracy factor by enabling the marksman to check that the axis of the barrel of the weapon is in fact contained in a vertical plane. The marksman of course checks this at the same time as he reads the elevation (or range) without any change in his field of vision, as in the embodiments illustrated in FIG. 16 and the following figure.

To provide this check the annular cylindrical tube 43 is simply replaced by an annular tube of rectangular section 54, as shown in section in FIG. 23. Its visible width L in the notched grid of graduations 55 is sufficient to allow the marksman to judge even a slight inclination of the liquid level, which is here represented by the line J.K. In this embodiment the liquid level thus fulfils a dual function in defining both range and verticality. The second function is generally described as correction of vertical slant.

It should be noted that the annular tube 54 may be replaced by two suitably spaced annular tubes, to enable any inclination of the weapon to be assessed.

FIGS. 25, 26 and 27 give an example of how the graduated scales can be adjusted.

It may be that for some reason the starting point 0 of the scale bas to be readjusted relative to the liquid level (in this case 44) while the axis of the barrel is perfectly horizontal. The shifting of the zero which has to be corrected may result from expansion, contraction, different fillings, for example. For ease of adjustment it is preferable for the adjusting system to be scaled.

In the FIG. 25 example adjustment is effected by rotating the graduated sector 56 about its centre 0, the angular displacement being brought about by rotating an eccentric ring 57 by means of its operating lever 58. The readjusting operation takes place when a clampling nut 59 and screw 60 are released.

FIG. 26 is a section taken along the line LM in FIG. 25 and FIG. 27 a section taken along the line NO in FIG. 26. The eccentric ring 57 pivots on the non-threaded part of the screw 60 inside the buttonhole milling 61, thus causing the graduated sector 56 (metric and hectrometric) to be displaced in the direction of the desired adjustment for an increase or reduction.

The sector 56 is then secured in its adjusted position by tightening the screw 60 and central nut 59.

FIG. 28 illustrates an arrangement which greatly reduces the space requirement of the aiming instrument. It consists of using only a fraction of the tubular ring in the part necessary for reading the elevation. The rest is replaced by a reserve 66 located nearest to the centre. The shape and cross section of the chamber are designed so that an angular displacement x will cause displacement of identical volumes at A and B.

FIG. 29 shows a system for damping the movement of the liquid. It comprises one or more balls 67 substantially smaller in diameter than the tube, which form a constriction to prevent untimely oscillations of the liquid column when the inclination is changed abruptly. In a different embodiment the ring or tube 43 may have a fixed constriction.

Depending on the violence with which the shot is discharged since this may give the arrangement on untimely shake, a low amplitude rudimentary shock absorber may be interposed between the aiming device proper and the means for fixing it on the weapon. This will enable the displacement to be limited and damped e.g. by taut abutments made of an appropriate flexible material capable of absorbing part of the energy.

The importance for the marksman of being sure that his weapon is ready either to fire grenades or to fire bullets normally should be emphasised.

The tilting of the instument, which moreover is very conspicuous, provides a very useful guarantee since it assures the user that his weapon is capable of bullet firing, firing by bursts or of firing round-by-round for grenade launching.

The folding back of the instrument, which automatically removes the locking stud, enables the marksman to avoid any mistake when he has to fire a normal round with a bullet.

With this arrangement, if the aiming instrument is not in the position of use for firing grenades, this will systematically prevent the marksman from using grenades.

Without the benefit of possible folding back, and if the locking stud remains in position without the marksman noticing it, he will only be able to fire round-by-round with his rifle, and with some models will even be obliged to operate the breech after every shot fired, which will endanger his action.

The marksman can return his weapon to the state of normal use for bullet firing by freeing the vent obturator with the aid of the pusher 30. This enables him to change the angular position by swinging the aiming instrument, after releasing it, to make its change of function quite obvious. In this way he avoids the incorrect operation which would consist of launching a grenade when the vent obturator is no longer in position, because the marksman, not being able to aim, cannot fire.

The fixing means are designed so that the instrument can be swung by rotating it around the barrel without taking it off. All that has to be done is to release the cam 26 without freeing the stirrup piece 25.

The position of the alidade may vary. It may equally be placed on the instrument, along its axis, to the left or right or on top.

A left hand side member which is fixed on the frame may be included in the design. A protective rubber jacket may cover the whole arrangement. This may be in two portions which adhere to one another.

The vertical aiming instrument may include a fastener for adjusting the distance between the instrument and the barrel of the gun. This arrangement enables the instrument to be varied in distance from the barrel. This can be done by means of a flexible fastener located between the fixing means and the frame. The flexible fastener may also be combined with the arrangement for bringing the aiming instrument closer to the barrel. Similarly, the arrangement for swinging the instrument to the left to put it out of action may be combined with the flexible arrangement or the arrangement for bringing the instrument closer to the barrel.

FIGS. 30 and 31 illustrate a ball-type vertical aiming arrangement comprising a plurality of balls 4. Its special feature is that the flange 7 has two scales 70, 71 so that the range reading is visible from two directions.

FIGS. 32 and 22 illustrate the indicating means of a vertical aiming arrangement comprising two annular tubes 72, 73 which are connected at 74 and partially filled with liquid. A scale 75 co-operates with the liquid levels 76, 77 appearing in two windows 78, 79 formed in a casing which is integral with the flange 7. This indicating means also enables the marksman to judge the vertical slant.

Finally, FIG. 34 is a perspective view of a preferred embodiment of the aiming arrangement. The tubular alidade 80 has sighting marks 6, 6' and is connected at 81 to the flange 7. The tube 80 may be painted internally with a phosphorescent paint to permit night firing. A mark 82 co-operates with a scale 83 carried by the flange 7, which is fixed to the barrel 1, to obtain the desired elevation value.

The aiming arrangement is of the type which uses a liquid. It has an indicator, e.g. like that described with reference to FIGS. 32 and 33, housed inside a protective casing 84.

For curved fire the instrument does not require any manual action during its use. Its preparation consists solely of proceeding to extend, incline and secure the alidade.

Angular displacement of the barrel from the horizontal leads to identical angular displacement of the liquid level, which has to be brought into registry with the graduation corresponding to the desired range, by inclining the weapon.

The two readings, for range and direction, which are located in the same ocular field, are direct and simultaneous. When the indication for the desired range is obtained and the alidade is in the direction of the target, the marksman is ready to fire his shot.

For flat-trajectory firing the pivoting alidade must be extended. The aperture in its adjoining runner is then brought opposite the selected distancemarked on the scale. The runner is then fixed, this position corresponding to the firing angle indicated.

The main advantages of the arrangements described are:

1. The instrument can be fixed quickly and easily on the rifle.

2. The lateral position of the aiming arrangement prevents the marksman from leaning his head far above the rifle. Being comfortable, he can consequently see the target through his line of sight like a gunner.

3. To adjust his curved fire the device has a geocentric reference which makes for accuracy. The possible correction of vertical slant, which is easily carried out, adds to the degree of precision obtained.

4. The opportunity given to the marksman to refer immediately to specific, constant reference marks, without hesitation or tentative, encourages rapid use.

5. Ease of use results from the absence of any manual adjustment (which also increases the speed of use) and from the fact that the two readings for range direction are direct and simultaneous.

6. The field of vision stands out well since the target is always unmasked.

7. Neither the alidade nor its concentric circles for optical centering mask the target, as the body of a grenade which acts as frontsight with a normal aiming grid is in danger of doing.

8. The reading window of the movable runner adjoining the alidade for direct fire is very conspicuous. The range numbers are clearly legible.

As stated, the instrument may be appropriate for several types of light weapons, whether they fire missiles at constant speeds or at different initial speeds. Thus when the missiles to be launched have a constant speed it may be advisable to use a reading plate graduated directly in meters and indicating the ranges, for the vertical aiming instrument. On the other hand, if the weapon launches missiles where the initial speed can be varied, it will then be advisable to use a reading area graduated in degrees corresponding to a firing table indicated in meters, as is the practice for certain mortars.

In an alternative form of the invention the chamber of the vertical aiming arrangement may be filled totally with two immiscible liquids such as mercury and alcohol.

What I claim is:

1. An aiming instrument for small arms weapons, comprising a frame, means to secure the frame to the barrel of a weapon, sighting means comprising an alidade carried by the frame and swingable about a horizontal axis relative to the frame to establish a vertical reference, a scale carried by the frame for reading said vertical reference in terms of range, said scale being visible from the rear to a user of the weapon, chamber means carried by said frame, said chamber means being arcuate about a horizontal axis, a volume of liquid in said chamber means, said chamber means having indicia to indicate the position of said body of liquid therein, the horizontal extent of said chamber means being substantially greater than the extent of said chamber means radially of the last-named axis, whereby any tilting of said axes is easily visible because said body of liquid then occupies different positions relative to said indicia on opposite sides of said chamber means.

2. An instrument according to claim 1, wherein the chamber means containing the liquid is formed by two parallel rings communicating at at least one point.

* * * * *